US010073401B2

(12) United States Patent
Sato

(10) Patent No.: US 10,073,401 B2
(45) Date of Patent: Sep. 11, 2018

(54) POST PROCESSING APPARATUS AND IMAGE FORMING APPARATUS

(71) Applicant: CANON KABUSHIKI KAISHA, Tokyo (JP)

(72) Inventor: Kazuhisa Sato, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/299,295

(22) Filed: Oct. 20, 2016

(65) Prior Publication Data

US 2017/0115620 A1 Apr. 27, 2017

(30) Foreign Application Priority Data

Oct. 23, 2015 (JP) ..... 2015-208877
Aug. 22, 2016 (JP) ..... 2016-162209

(51) Int. Cl.
*G03G 15/00* (2006.01)

(52) U.S. Cl.
CPC ..... *G03G 15/6544* (2013.01); *G03G 15/6538* (2013.01); *G03G 15/6552* (2013.01); *G03G 15/6576* (2013.01)

(58) Field of Classification Search
CPC ..... G03G 15/6544; G03G 15/6538; G03G 15/6552; G03G 15/6576; B65H 29/70; B65H 2801/24; B65H 2801/27; B65H 2801/31; B65H 29/52
See application file for complete search history.

(56) References Cited

U.S. PATENT DOCUMENTS

2007/0242987 A1* 10/2007 Shida ..... B65H 37/00 399/320
2012/0224902 A1* 9/2012 Chiwata ..... B65H 31/02 400/578
2015/0353316 A1* 12/2015 Abe ..... B65H 37/04 270/58.08
2016/0089912 A1* 3/2016 Chiba ..... B41J 11/0005 347/6
2017/0050450 A1* 2/2017 Chiba ..... B65H 29/247

FOREIGN PATENT DOCUMENTS

JP 60-52459 A 3/1985
JP 2000-159422 A 6/2000
JP 2000-272810 A 10/2000
JP 2006-089197 A 4/2006
JP 2009-249049 A 10/2009

* cited by examiner

*Primary Examiner* — David Banh
(74) *Attorney, Agent, or Firm* — Canon U.S.A. Inc., IP Division

(57) ABSTRACT

A post processing apparatus is attachable to an image forming apparatus. In a state in which a concavely curled recording material is placed on a second placement unit, when a plurality of the recording materials which are convexly curled are discharged to the second placement unit, a control unit causes a post processing unit to perform specified post processing on at least one recording material of the plurality of recording materials, causes a discharging unit to discharge the at least one recording material to the second placement unit, and after the discharge, causes the post processing unit to perform the specified post processing on the recording material or the recording materials of the plurality of recording materials other than the at least one recording material.

25 Claims, 9 Drawing Sheets

POST PROCESSING APPARATUS AND IMAGE FORMING APPARATUS

BACKGROUND OF THE INVENTION

Field of the Invention

Aspects of the present disclosure relate to a post processing apparatus and an image forming apparatus that perform post processing such as a shifting process on a recording material on which an image is formed.

Description of the Related Art

A post processing apparatus has the functions of performing post processing such as a shifting process on sheets of paper conveyed from an image forming apparatus and placed on a processing tray and discharging a batch of the sheets having undergone the post processing to a placement tray.

In some cases, the sheets conveyed to the post processing apparatus are curled. When the sheets are curled, the post processing apparatus is not necessarily able to accurately perform the post processing. Consequently, placement suitability of the sheets is degraded. In order to address this, a variety of methods have been proposed for correcting such curl of sheets.

For example, Japanese Patent Laid-Open No. 60-52459 describes a technique for correcting curl of sheets with a dedicated decurler mechanism that corrects curl of sheets by bringing decurl rollers into pressure contact with sheets. Japanese Patent Laid-Open No. 2006-089197 describes a technique for correcting curl of sheets by moving upward a placement tray on which a batch of sheets are placed so as to bring the upper surface of the batch of sheets into contact with a top plate.

Here, with the technique described in Japanese Patent Laid-Open No. 60-52459 in which curl is corrected by the decurl rollers, the structure of a device becomes complex because of the dedicated decurler mechanism. This increases the cost and the size of the device. With the technique described in Japanese Patent Laid-Open No. 2006-089197, since the placement tray is moved close to the top plate, new sheets cannot be received during decurling. This degrades productivity.

SUMMARY OF THE INVENTION

Aspects of the present disclosure provide a post processing apparatus and an image forming apparatus which have simple structures and good placement suitability without a dedicated mechanism for decurling and without degradation of productivity.

According to a first aspect of the present disclosure, a post processing apparatus which is attachable to an image forming apparatus includes a first placement unit, a post processing unit, a discharging unit, a second placement unit, and a control unit. A recording material conveyed from the image forming apparatus is placed on the first placement unit. The post processing unit performs specified post processing on the recording material placed on the first placement unit. The discharging unit discharges the recording material placed on the first placement unit after the specified post processing has been performed by the post processing unit. The recording material discharged by the discharging unit is placed on the second placement unit. The control unit controls the post processing unit and the discharging unit. In a state in which the post processing apparatus is attached to the image forming apparatus and the recording material which is concavely curled relative to a placement surface of the second placement unit is placed on the second placement unit, when a plurality of the recording materials which are convexly curled relative to the placement surface of the second placement unit are discharged to the second placement unit, the control unit performs post processing control in which the control unit causes the post processing unit to perform the specified post processing on at least one recording material of the plurality of recording materials, causes the discharging unit to discharge the at least one recording material to the second placement unit, and after the discharge, causes the post processing unit to perform the specified post processing on a recording material or recording materials of the plurality of recording materials other than the at least one recording material, and causes the discharging unit to discharge the recording material or the recording materials of the plurality of recording materials other than the at least one recording material to the second placement unit.

According to a second aspect of the present disclosure, an image forming apparatus includes an image forming unit, a first placement unit, a post processing unit, a discharging unit, a second placement unit, and a control unit. The image forming unit forms an image on a recording material. The recording material on which the image formed by the image forming unit is placed on the first placement unit. The post processing unit performs specified post processing on the recording material placed on the first placement unit. The discharging unit discharges the recording material placed on the first placement unit after the specified post processing has been performed by the post processing unit. The recording material discharged by the discharging unit is placed on the second placement unit. The control unit controls the post processing unit and the discharging unit. In a state in which the recording material which is concavely curled relative to a placement surface of the second placement unit is placed on the second placement unit, when a plurality of the recording materials which are convexly curled relative to the placement surface of the second placement unit are discharged to the second placement unit, the control unit performs post processing control in which the control unit causes the post processing unit to perform the specified post processing on at least one recording material of the plurality of recording materials, causes the discharging unit to discharge the at least one recording material to the second placement unit, and after the discharge, causes the post processing unit to perform the specified post processing on a recording material or recording materials of the plurality of recording materials other than the at least one recording material, and causes the discharging unit to discharge the recording material or the recording materials of the plurality of recording materials other than the at least one recording material to the second placement unit.

Further features of the present disclosure will become apparent from the following description of exemplary embodiments with reference to the attached drawings.

DESCRIPTION OF THE EMBODIMENTS

Embodiments of the present disclosure will be described below with reference to the drawings.

First Embodiment

Figure 1:
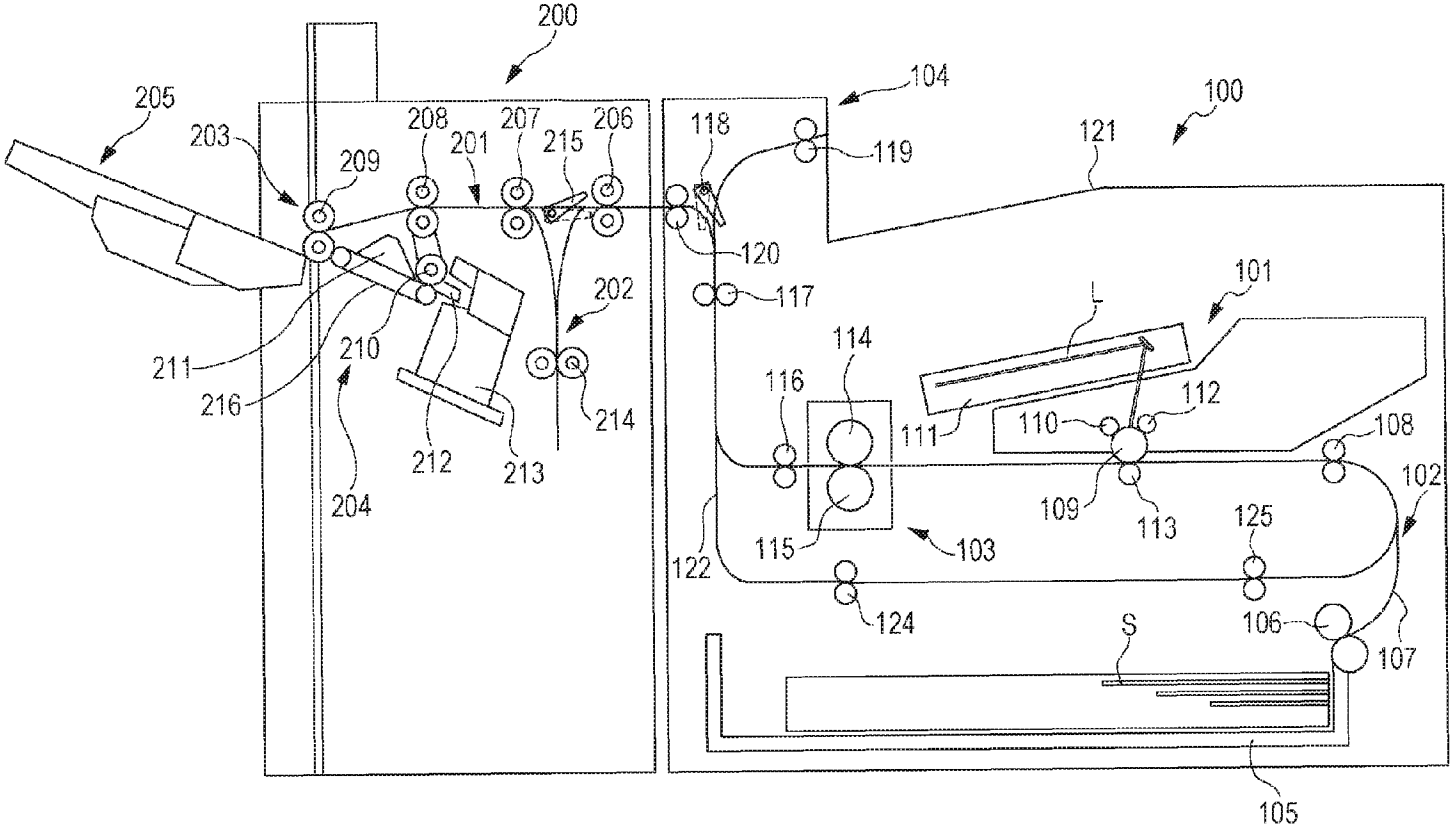
FIG. 1 illustrates an outline of an image forming apparatus and a post processing apparatus according to a first embodiment.

The embodiments of the present disclosure will be described in detail below with reference to the drawings. Outlines of an image forming apparatus 100 and a post processing apparatus 200 will be described below with reference to FIG. 1.

The Image Forming Apparatus

The image forming apparatus 100 includes an image forming device 101, a sheet feed and conveyance device 102, a fixing device 103, and a sheet discharging device 104. The sheet feed and conveyance device 102 feeds and conveys a sheet of paper S (recording material) to the image forming device 101. The image forming device 101 includes a photosensitive drum 109, a charging roller 110, a light exposure device 111, a developing device 112, and a transfer roller 113. The charging roller 110 charges the photosensitive drum 109. The charged photosensitive drum 109 is exposed to light by using the light exposure device 111, thereby an electrostatic latent image is formed on the photosensitive drum 109. The developing device 112 supplies toner to the photosensitive drum 109 so as to visualize the electrostatic latent image formed on the photosensitive drum 109. A toner image having been formed as described above is transferred by the transfer roller 113 onto the sheet S having been fed and conveyed. Thus, the image forming device 101 forms the toner image on the sheet S.

The sheet feed and conveyance device 102 includes a cassette 105, a sheet feed roller 106, a conveyance guide 107, a registration roller 108, and so forth. The cassette 105 can contain a plurality of sheets S to be subjected to image formation. The fixing device 103 includes a fixing roller 114, a pressure roller 115, and a fixing discharging roller 116. The pressure roller 115 is contacted by the fixing roller 114 from below. The sheet discharging device 104 includes a conveyance roller 117, a conveyance path switching member 118, a face down (FD) roller 119, a face up (FU) roller 120, and a face down (FD) tray 121. The conveyance roller 117 is rotatable in the forward and reverse directions. The FD tray 121 is formed in an upper surface of the image forming apparatus 100. The conveyance path switching member 118 is switchable between the following positions: a position indicated by a solid line in FIG. 1 for conveying to the post processing apparatus 200 the sheet S on which an image has been formed and a position indicated by a broken line in FIG. 1 for conveying to the FD tray 121 the sheet S on which an image has been formed. Furthermore, a duplex conveyance path 122 is provided between the cassette 105 and a region where the image forming device 101 and the fixing device 103 are disposed. The duplex conveyance path 122 is used when images are formed on both the front and back sides of the sheet S.

In order to perform duplex printing on the sheet S, the sheet S onto the front side of which the toner image has been fixed is conveyed by the fixing discharging roller 116 and the conveyance roller 117 toward the sheet discharging device 104. When the trailing edge of the sheet S reaches a specified position, the conveyance roller 117 is rotated in the reversed direction, thereby the sheet S is fed to the duplex conveyance path 122. After that, the sheet S is conveyed and fed again by a duplex conveyance roller 124 and a duplex refeed roller 125 so as to form an image on the back side of the sheet S.

In order to convey to the post processing apparatus 200, the conveyance path switching member 118 is held at the position indicated by the solid line, thereby feeding to the FU roller 120 the sheet S on the front side or both sides of which printing is performed. The sheet S is then conveyed by the FU roller 120 so as to be conveyed to the post processing apparatus 200.

The Post Processing Apparatus

The post processing apparatus 200 can perform specified post processing on the sheet S discharged from the image forming apparatus 100. Examples of the post processing performed by the post processing apparatus 200 include, for example, a stapling process, a bookbinding process, and a shifting process. In the stapling process, a specified number of the sheets S are placed and bound at a position near a certain end portion. In the bookbinding process, a specified number of the sheets S are placed and center folded or saddle stitched. In the shifting process, the position of the sheet S is shifted while being aligned in the width direction of the sheet S. Also, the post processing apparatus 200 can perform a stacking process through which the sheet S having been discharged from the image forming apparatus 100 is discharged from the post processing apparatus 200 without any process performed on it.

The post processing apparatus 200 includes a sheet conveyance path 201, an inversion conveyance path 202, a post-processing sheet discharging device 203, a processing tray 204 (first placement unit), a stapler 213, and a placement tray 205 (second placement unit). The placement tray 205 is movable in the up-down direction. A first conveyance roller 206, a second conveyance roller 207, and a third conveyance roller 208 are disposed along the sheet conveyance path 201 so as to convey the sheet S to the post-processing sheet discharging device 203. An inversion roller 214 rotatable in the forward and reverse directions is provided along the inversion conveyance path 202. A sheet discharging roller 209 (discharging unit) rotatable in the forward and reverse directions is provided in the post-processing sheet discharging device 203. Furthermore, an inversion conveyance path switching device 215 is provided downstream of the first conveyance roller 206. In the post processing apparatus 200, when a conveyance inversion instruction is issued, the inversion conveyance path switching device 215 is held at a position indicated by a solid line so as to feed the sheet S to the inversion conveyance path 202. When the trailing edge of the sheet S reaches a specified position, the rotation of the inversion roller 214 is reversed, thereby the sheet S is conveyed toward the second conveyance roller 207 first from the trailing edge side of the sheet S.

The sheet S to be subjected to the shifting process and the stapling process is temporarily placed on the processing tray 204. In order to place the sheet S on the processing tray 204, the sheet discharging roller 209 is rotated in the forward direction so as to receive the sheet S and, at a time when the trailing edge of the sheet S reaches a specified position downstream of the third conveyance roller 208, the rotation of the sheet discharging roller 209 is reversed so as to feed the sheet S to the processing tray 204.

An alignment paddle 210 aligns the sheet S in a sheet discharging direction of the sheet S by causing the sheet S received by the processing tray 204 to abut an injector 212 which is a trailing edge stopper having a substantially U shape. A jogger unit 211 aligns the sheet S placed on the processing tray 204 in a direction parallel to a placement surface of the processing tray 204 on which the sheet S is placed and perpendicular to the sheet discharging direction (discharging direction) of the sheet S, that is, in the width direction of the sheet S. In order to perform the shifting process, the jogger unit 211 operates so as to shift the position of the sheet S in the width direction in addition to aligning the sheet S placed on the processing tray 204. In order to perform the stapling process, the stapler 213 performs a binding process on a batch of sheets aligned by the alignment paddle 210 and the jogger unit 211.

A conveyance mechanism 216 and the injector 212 operate so as to discharge to the placement tray 205 the sheets S on which the post processing such as the shifting process and the stapling process have been performed. The conveyance mechanism 216 and the injector 212 are attached so as to be integrated with each other (referred to as "batch discharging mechanism" hereafter). The batch discharging mechanism (discharging unit) is driven by the same motor (not illustrated) so as to perform a reciprocating motion that includes a movement in the placement tray 205 direction and a movement returning to the home position.

Control Block Diagram

Figure 2:
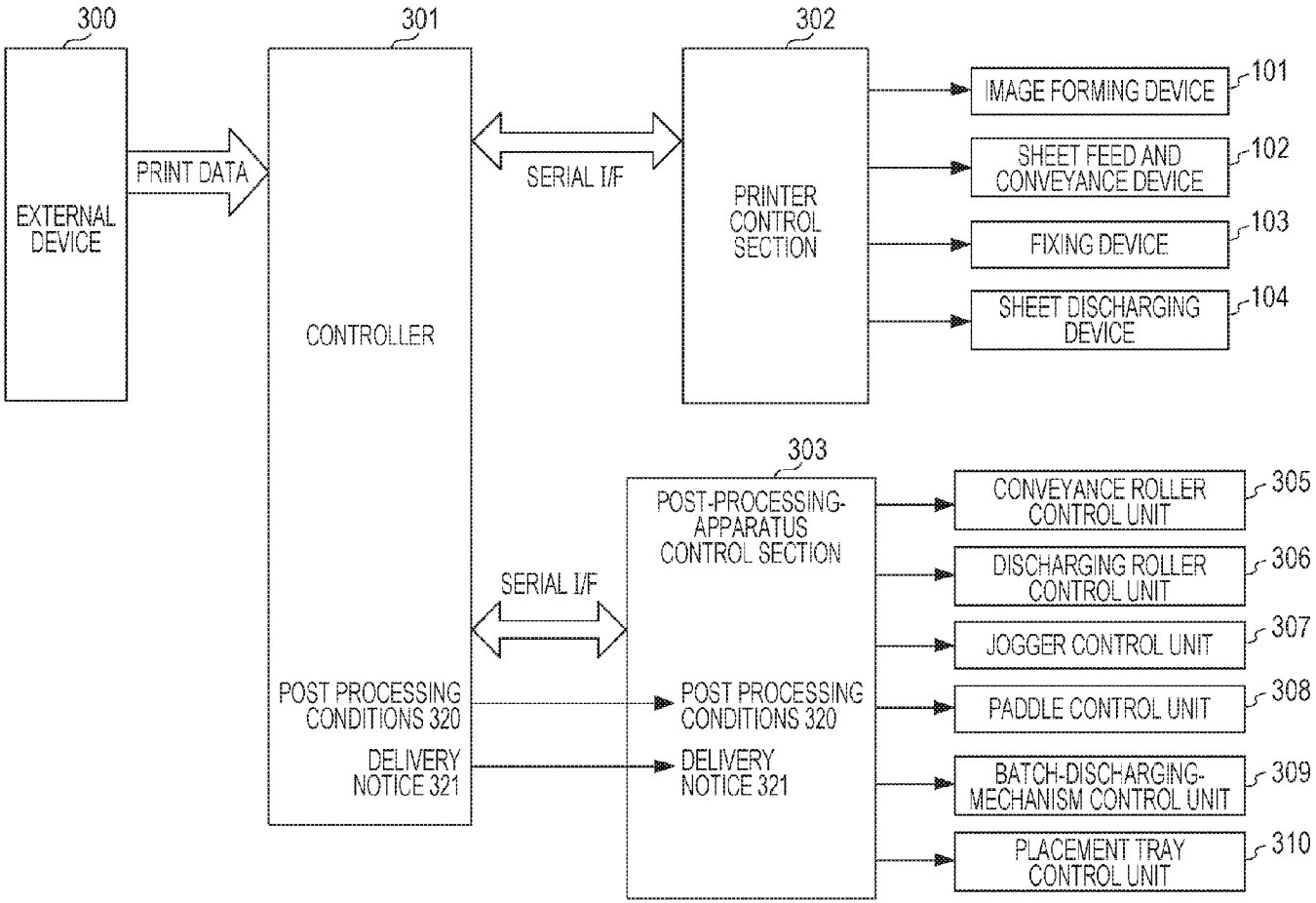
FIG. 2 is a block diagram of a functional configuration according to the first embodiment.

FIG. 2 is a block diagram of a functional configuration according to the present embodiment. As control sections, a printer control section 302 that controls the image forming apparatus 100 and a post-processing-apparatus control section 303 (referred to as "control section 303" hereafter) that controls the post processing apparatus 200 are provided. A controller 301 communicates with an external device 300 such as a host computer and receives print data. Also, the controller 301 transmits specification of print conditions produced from the print data to the printer control section 302 through a serial interface (I/F) so as to issue a print instruction. The printer control section 302 controls the mechanisms in accordance with the print conditions received from the controller 301. Specifically, the printer control section 302 controls the sheet feed and conveyance device 102 and the sheet discharging device 104 so as to feed and discharge the sheet S and controls the image forming device 101 and the fixing device 103 so as to form an image on the sheet S and fixed the image onto the sheet S.

The controller 301 specifies post processing conditions 320 produced from the print data for the control section 303 through a serial interface (I/F). The post processing conditions 320 include the paper type, the paper size, the number of sheets, a print state such as simplex printing or duplex printing, specification of the post processing method such as a shifting process or a stapling process, and delimiting information such as a first sheet or a last sheet in a print job.

Furthermore, the controller 301 transmits a delivery notice 321 signal at timing at which the sheet S is conveyed to the control section 303 through the serial I/F. Upon reception of the delivery notice 321 signal, the control section 303 controls the mechanisms in accordance with the post processing conditions 320 received from the controller 301. A conveyance roller control unit 305 controls the first to third conveyance rollers 206 to 208 and the inversion roller 214. A discharging roller control unit 306 controls the sheet discharging roller 209. A jogger control unit 307 controls the jogger unit 211. A paddle control unit 308 controls the alignment paddle 210. A batch-discharging-mechanism control unit 309 controls the batch discharging mechanism. A placement tray control unit 310 controls the placement tray 205. Thus, the control section 303 uses the control units to perform specified post processing.

Each of the control units may include, for example, a stepping motor as a drive source and a timing belt and pulleys or the like that translate the axial rotation of the stepping motor into reciprocation. Alternatively, reciprocation may be realized by a direct current (DC) motor or a DC motor and a rack-and-pinion mechanism.

Operations of the Post Processing Apparatus

Next, operations of the post processing apparatus 200 in the shifting process are described. When the sheet S is fed from the image forming apparatus 100 to the post processing apparatus 200, as described above, the sheet S passes through the sheet conveyance path 201 and the inversion conveyance path 202 and is conveyed by the third conveyance roller 208. The sheet S is conveyed partway toward the placement tray 205 by the sheet discharging roller 209 and, when the trailing edge of the sheet S reaches a specified position downstream of the third conveyance roller 208, conveyed to the processing tray 204 by the sheet discharging roller 209. The sheet S placed on the processing tray 204 is aligned by the alignment paddle 210 and subjected to the shifting process performed by the jogger unit 211.

In order to perform the shifting process on a plurality of sheets S, the post processing apparatus 200 performs the same or a similar operations on a specified number of the sheets S, and when the specified number of the sheets S are placed on the processing tray 204, the post processing apparatus 200 moves the batch discharging mechanism to the placement tray 205 so as to discharge the batch of sheets S.

FIGS. 3A to 3D illustrate operations in which, when the sheet S that is curled upward is placed on the placement tray 205, five sheets that are curled downward are subjected to the shifting process and placed on the placement tray 205. Here, the upward curled sheet is concavely curled relative to a placement surface of the placement tray 205 upward in a vertical direction. In other words, it can be said that the upward curled sheet is curved such that the leading edge and the trailing edge of the upward curled sheet are positioned above the center of the sheet in the vertical direction. The downward curled sheet is convexly curled relative to the placement surface of the placement tray 205 upward in a vertical direction. In other words, it can be said that the downward curled sheet is curved such that the leading edge and the trailing edge of the downward curled sheet are positioned below the center of the sheet in the vertical direction.

One of the causes of such curl occurring in a sheet is the amount of heat applied to the sheet by the fixing device 103. When the heat amount is applied to the sheet by the fixing device 103 so as to fix a toner image onto the sheet, moisture contained in the sheet is vaporized, thereby shrinking the sheet. At this time, the heat amount applied to the sheet may differ between the front and rear sides of the sheet depending on the structure of the fixing device 103. In such a case, upward curl or downward curl occurs. For example, with the structure according to the present embodiment, it is assumed that downward curl occurs in the sheets having undergone duplex printing and upward curl occurs in the sheets S having undergone simplex printing.

Figure 3A:
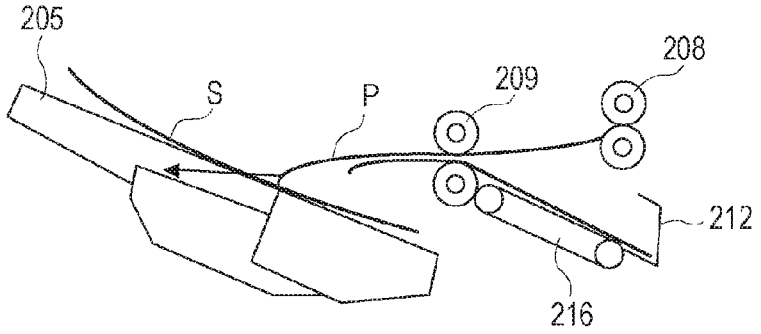
FIGS. 3A to 3D illustrate placement states in a related-art shifting process performed on downward curled sheets.

In FIG. 3A, newly conveyed sheets P are sequentially placed on the processing tray 204 when the upward curled sheet S is placed on the placement tray 205. One of the sheets P having conveyed from the image forming apparatus 100 is conveyed in the placement tray 205 direction until a time when the rotation of the sheet discharging roller 209 is reversed so as to convey this sheet P to the processing tray 204. At this time, a frictional force between the sheet S and this sheet P is high because the leading edge of the sheet P in contact with the sheet S is curled downward. Thus, a force resisting a movement of the sheet P acts on the sheet P. However, the leading edge of the sheet P is ejected upward at certain timing, and accordingly, slightly pushes the sheet S in an arrow direction of FIG. 3A.

Figure 3B:
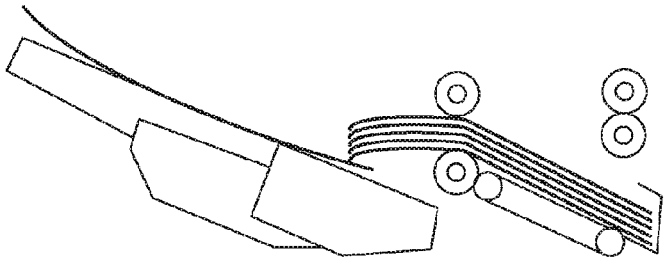
Figure 3C:
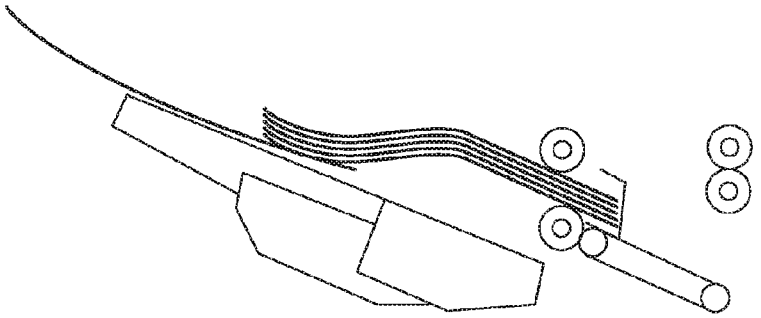
Figure 3D:
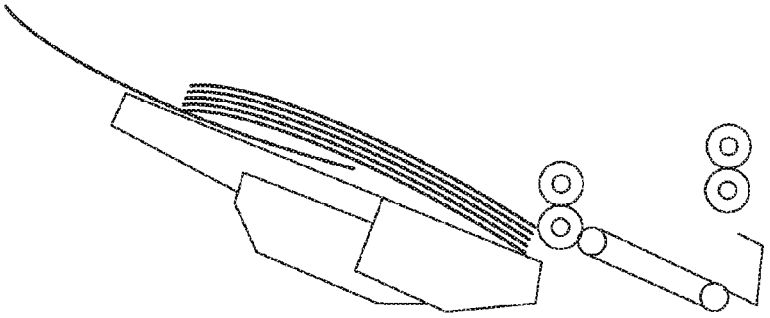

In FIG. 3B, five downward curled sheets P are placed on the processing tray 204. At this time, the phenomenon of FIG. 3A has occurred five times in the sheet S on the placement tray 205. Thus, the sheet S is further pushed than in the state of FIG. 3A. In FIGS. 3C and 3D, the batch discharging mechanism is moved in the placement tray 205 direction so as to discharge the batch of the sheets into the placement tray 205. As illustrated in FIG. 3C, when the batch of the downward curled sheets is discharged, the batch of the sheets is discharged while gradually pushing the sheet S due to a high frictional force between the sheet S and the butch of the sheets. At last, as illustrated in FIG. 3D, the sheet S is partially moved out of the placement tray 205.

Figure 4:
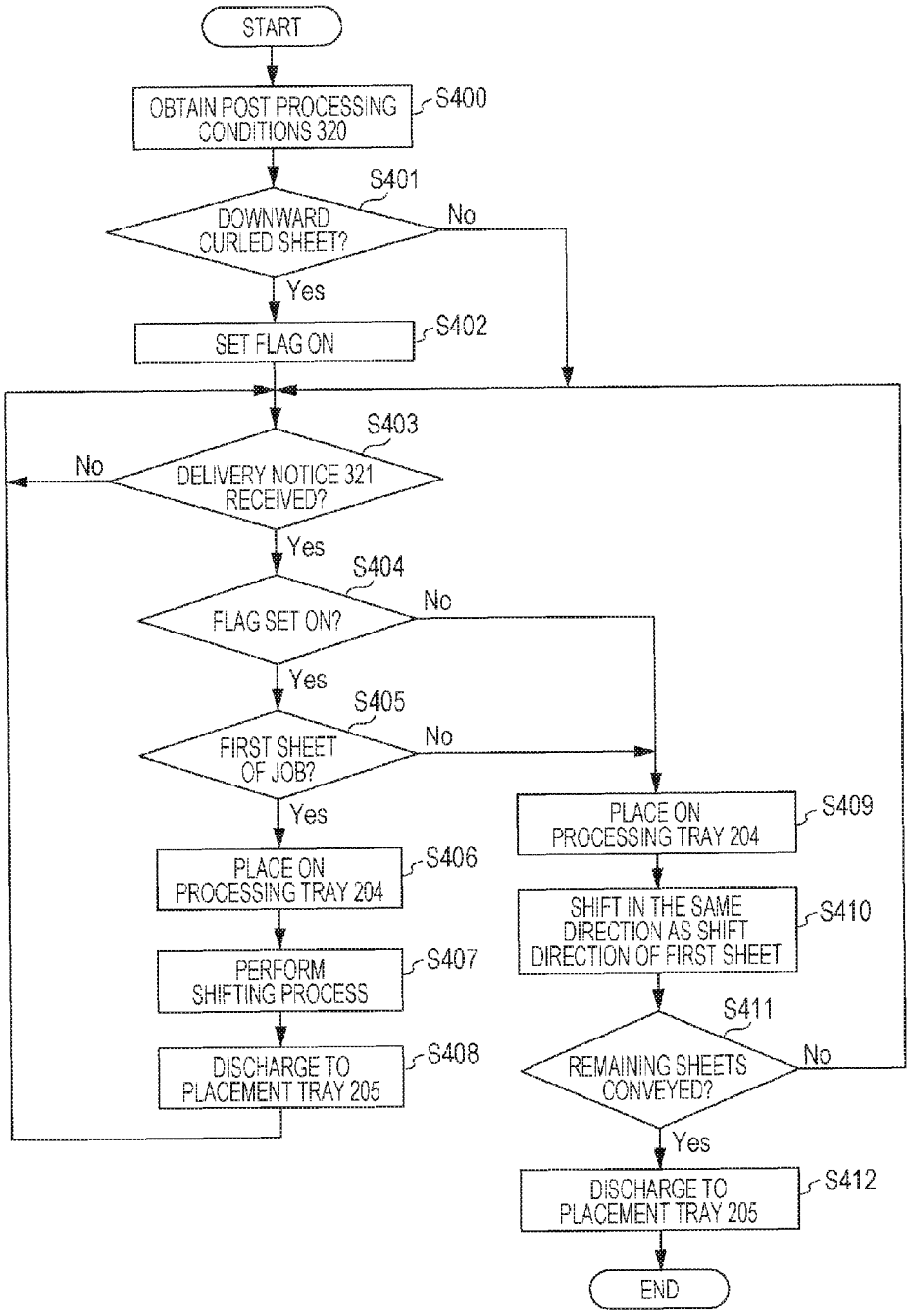
FIG. 4 is a flowchart of post processing control according to the first embodiment.

In order to address the problem of degrading placement suitability of the sheets as described above, the following control is performed according to the present embodiment. FIG. 4 is a flowchart illustrating the operations of the post processing apparatus 200 according to the present embodiment. Types of control in accordance with the flowchart are performed by the control section 303 in accordance with software stored in a read only memory (ROM; not illustrated) or the like.

When a print job is started, the control section 303 obtains the post processing conditions 320 from the controller 301 (S400). The control section 303 determines whether or not the sheet to be conveyed is to be curled downward from the post processing conditions 320 (S401). The conditions for the determination on whether or not the sheet is to be curled downward are determined in accordance with data obtained in advance.

The control section 303 sets ON a flag for placement-suitability improvement control when determining that the sheet is to be curl downward (S402). Next, the control section 303 waits for reception of the delivery notice 321 so as to check whether or not the sheet is conveyed from the image forming apparatus 100 (S403).

Upon reception of the delivery notice 321, the control section 303 checks whether or not the flag is set ON (S404). When the flag is set ON, the control section 303 checks whether or not the sheet is a first sheet of the print job (S405). When the sheet is the first sheet, the control section 303 causes the sheet discharging roller 209 and the like to place the first sheet on the processing tray 204 (S406), so that the first sheet is subjected to the shifting process performed by the jogger unit 211 (S407). Then, the control section 303 causes the batch discharging mechanism and the like to discharge the first sheet to the placement tray 205 (S408). When the discharge of the first sheet is completed, the control section 303 waits for the delivery notice 321 so as to receive the remaining sheets of the print job.

When it has been determined in S401 that the sheet is not to be curled downward, the control section 303 advances to processing of S403 so as to wait for the conveyance of the sheet from the image forming apparatus 100. Even after the delivery notice 321 has been received, the control section 303 causes a plurality of sheets to be sequentially placed on the processing tray 204 when the flag is not set ON in accordance with the determination in S404 or the sheet is not the first sheet of the job (S409). Then the control section 303 causes the plurality of sheets to be subjected to the shifting process in the same direction as that of the first sheet (S410). The control section 303 checks whether or not the remaining sheets of the job have been conveyed (S411). When the conveyance of all the remaining sheets of the print job is completed, the control section 303 causes the batch of the sheets to be discharged to the placement tray 205 (S412).

Figure 5A:
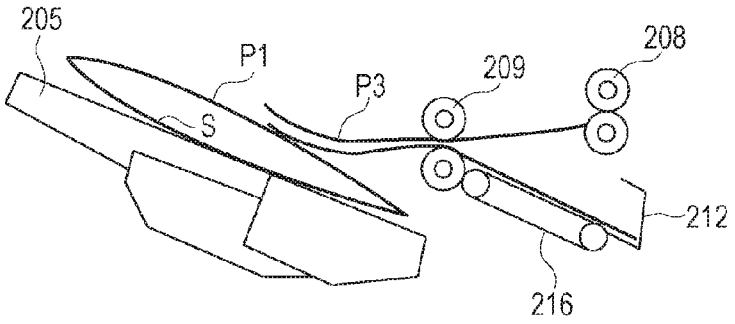
FIGS. 5A to 5C are sectional views illustrating placement states of sheets in the post processing control according to the first embodiment.
Figure 5B:
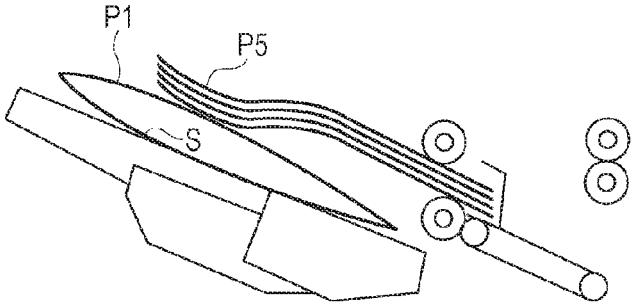
Figure 5C:
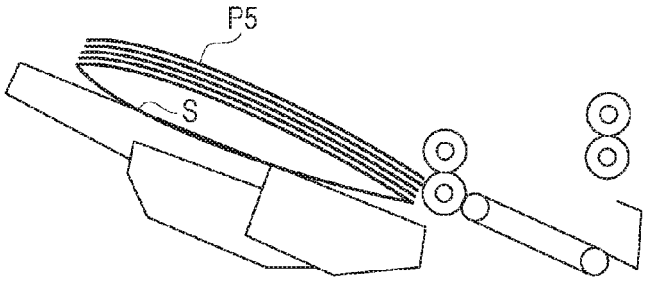
Figure 6A:
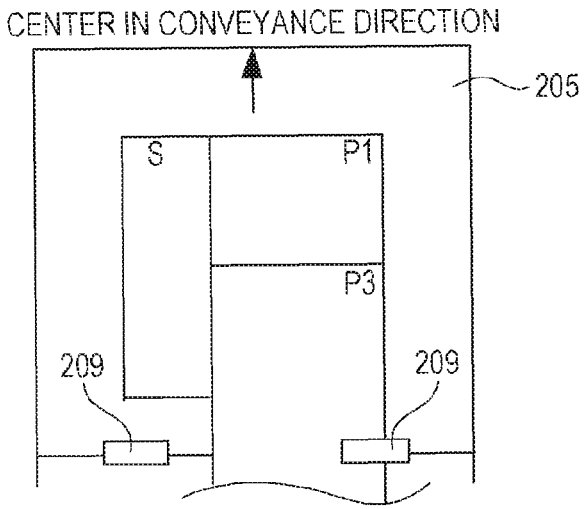
FIGS. 6A to 6C are top views illustrating the placement states of the sheets in the post processing control according to the first embodiment.
Figure 6B:
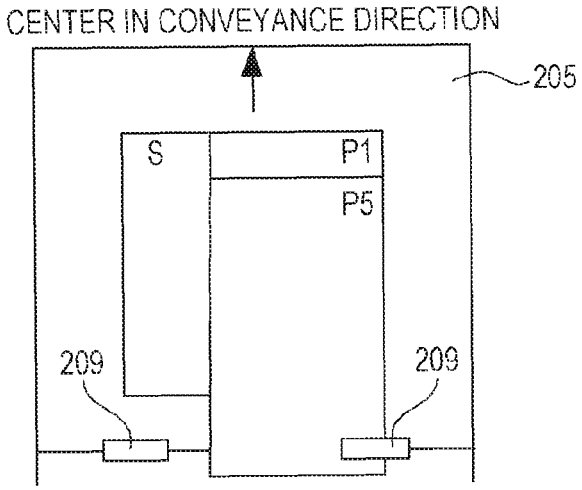
Figure 6C:
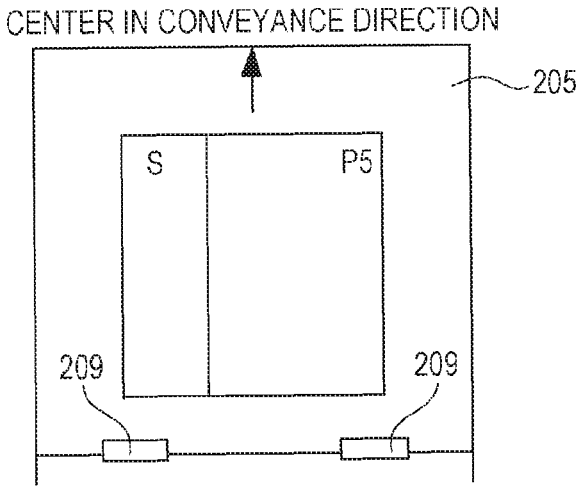

FIGS. 5A to 6C illustrate placement states while the operations according to the present embodiment are being performed. FIGS. 5A to 5C correspond to FIGS. 6A to 6C. The states illustrated in FIGS. 5A to 5C are respectively the same as the states illustrated in FIGS. 6A to 6C. FIGS. 5A to 5C are sectional views of the post processing apparatus 200 and FIGS. 6A to 6C are top views of the post processing apparatus 200.

FIGS. 5A and 6A illustrate the state of the placement tray 205 after processing from S400 to S410 has been performed. Here, the sheet S represents a sheet that has already been placed on the placement tray 205 and the sheets P1 to P5 represent sheets newly discharged to the placement tray 205.

When processing from S400 to S408 is performed while the upward curled sheet S is placed on the placement tray 205, only a downward curled single sheet P1 is shifted and placed on the sheet S. By doing this, the remaining sheets of the print job conveyed from the image forming apparatus 100 are conveyed in the placement tray 205 direction while being in contact with the sheet P1 until a time when the rotation of the sheet discharging roller 209 is reversed so as to place the remaining sheets in the processing tray 204. The frictional force between the downward curled sheet P1 and part of each of the remaining sheets in contact with the downward curled sheet P1 is reduced compared to the frictional force between the upward curled sheet S and part of the remaining sheet in contact with the upward curled sheet S. Accordingly, unlike the case as described with reference to FIGS. 3A to 3D, the remaining sheets are conveyed along the sheet P1 without the leading edges of the remaining sheets being ejected upward. Thus, the sheet S and the sheet P1 having already been placed on the placement tray 205 are not pushed out.

FIGS. 5B and 5C and FIGS. 6B and 6C illustrate the states of the placement tray 205 after processing from S411 to S412 has been performed. When all the remaining sheets P2 to P5 of the print job have been conveyed, the batch of the sheets is discharged. Also at this time, the sheets are discharged along the sheet P1 without pushing out the sheet S and the sheet P1. As a result, as illustrated in FIGS. 5C and 6C, the degree of alignment with which the sheet S and the batch of the sheets including the sheet P1 are placed on the placement tray 205 is high.

According to the present embodiment as described above, a post processing apparatus can have good placement suitability without the use of a dedicated decurler mechanism even when a curled sheet is conveyed to the post processing apparatus. Furthermore, since no particular spacing between the sheets is necessary, the productivity is not degraded.

Although the post processing performed by the post processing apparatus 200 is exemplified by the shifting process according to the above-described first embodiment, this is not limiting. Also, aspects of the present disclosure can be applied to a so-called stacking process in which a plurality of sheets are simply placed on the processing tray 204 once and collectively discharged to the placement tray 205.

Furthermore, in the above-described first embodiment, control is described by which a first sheet of a plurality of sheets is discharged in advance to the placement tray 205. However, this is not limiting. In the case of a job where, for example, five sheets are discharged to the placement tray 205, the following control may be performed: two or three sheets which are at least less than five sheets (not all of the sheets) are discharged in advance to the placement tray 205. In this way, the placement suitability is improved compared to a related-art method with which five sheets are collectively discharged from the processing tray 204 to the placement tray 205.

Furthermore, according to the above-described first embodiment, as described in the flowchart of FIG. 4, control by which a first sheet is discharged in advance to the placement tray 205 is performed for every batch of sheets to be curled downward. Alternatively, post processing control may be switched in accordance with information of a previous job. That is, the post processing control is switched to the related-art control by which the sheets are collectively discharged when the control section 303 can determine that a sheet having already been placed on the placement tray 205 is curled downward in accordance with the previous job information or there is no sheet placed on the placement tray 205.

Second Embodiment

According to a second embodiment, the post processing apparatus 200 performs the stapling process. A stapling operation cannot be performed unless all of plurality of target sheets are placed on the processing tray 204. For this reason, unlike the first embodiment, it is impossible that one or some of the sheets of a job subjected to the post processing are discharged in advance from the processing tray 204 to the placement tray 205. Since description of a main part of the second embodiment is similar to or the same as that of the first embodiment, only part of the second embodiment different from the first embodiment is described here.

Figure 7A:
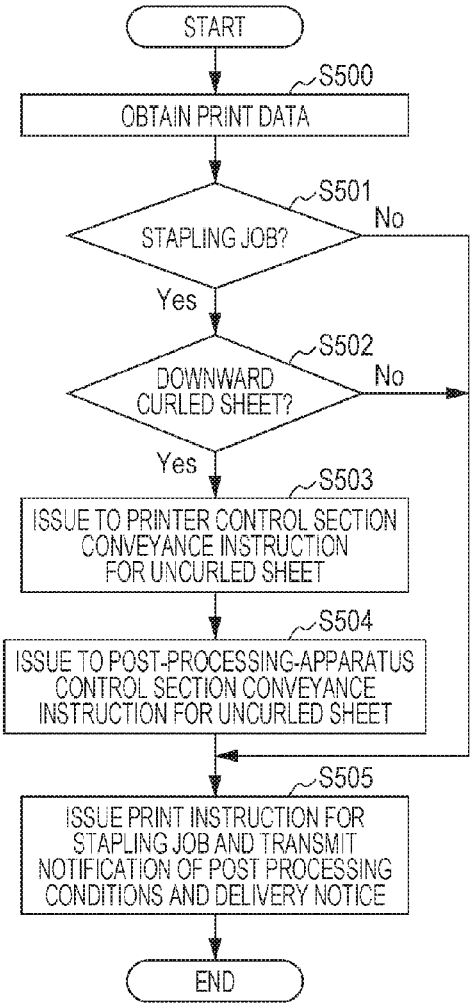
FIGS. 7A and 7B are flowcharts of an image forming apparatus and a post processing control according to a second embodiment.

FIG. 7A is a flowchart illustrating operations of the image forming apparatus 100 according to the present embodiment. Types of control in accordance with the flowchart of FIG. 7A are performed by the controller 301 in accordance with software stored in a ROM (not illustrated) or the like.

Initially, upon obtaining print data from the external device 300 (S500), the controller 301 determines whether a stapling job is to be performed (S501). When the controller 301 determines that the stapling job is to be performed, the controller 301 determines whether or not target sheets of the stapling job are to be curled downward (S502). The conditions under which whether or not the sheets are to be curled downward are the same as those of the first embodiment. That is, the controller 301 determines that the sheets having undergone duplex printing are to be curled downward and the sheets having undergone simplex printing are to be curled upward.

When it is determined that the sheets are to be curled downward, the controller 301 issues a conveyance instruction to the printer control section 302 so as to convey an uncurled sheet to the placement tray 205 of the post processing apparatus 200 (S503). Also, the controller 301 issues a conveyance instruction to the control section 303 so as to convey the uncurled sheet to the placement tray 205 of the post processing apparatus 200 (S504). Here, the uncurled sheet refers to a blank sheet on which no image is formed.

When the conveyance of the uncurled sheet to the placement tray 205 of the post processing apparatus 200 is completed, the controller 301 issues a print instruction corresponding to the stapling job and transmits notifications of post processing conditions 320 and the delivery notice 321 to the printer control section 302 and the control section 303 (S505). When it is determined in S501 that the stapling job is not to be performed or it is determined in S502 that the sheets are not to be curled downward, the controller 301 executes processing of S505.

Figure 7B:
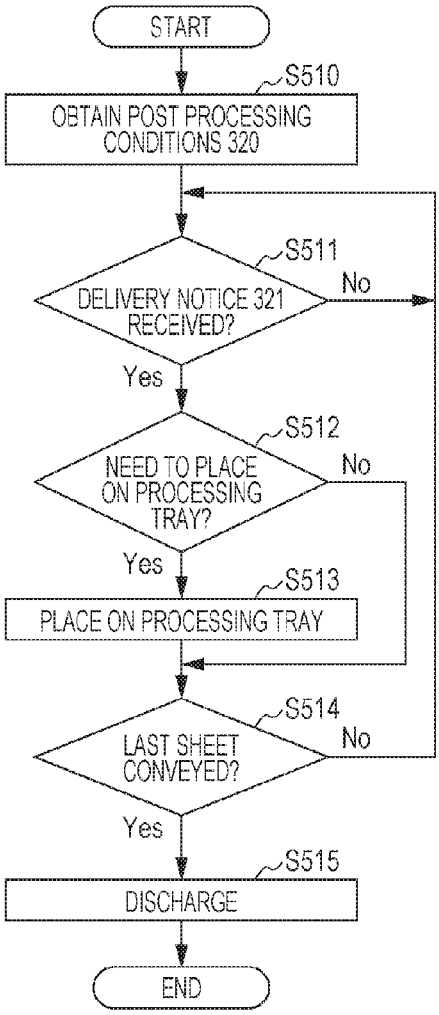

FIG. 7B is a flowchart illustrating operations of the post processing apparatus 200 according to the present embodiment. Types of control in accordance with the flowchart of FIG. 7B are performed by the control section 303 in accordance with software stored in a ROM (not illustrated) or the like.

When the print job is started, the control section 303 obtains the post processing conditions 320 from the controller 301 (S510). The control section 303 waits for reception of the delivery notice 321 (S511). Upon reception of the delivery notice 321, the control section 303 determines whether or not the sheet to be delivered is needed to be placed on the processing tray 204 in accordance with the post processing conditions 320 (S512). When it is determined that the sheet to be delivered is needed to be placed on the processing tray 204, the control section 303 causes this sheet to be placed on the processing tray 204 (S513). After the placement of this sheet on the processing tray 204 is completed or when it is determined in S512 that the placement of the sheet on the processing tray 204 is not needed, the control section 303 determines whether or not a last sheet of the print job has been conveyed in accordance with the post processing conditions 320 (S514). When it is determined that the last sheet has been conveyed, the control section 303 causes this sheet to be discharged to the placement tray 205 (S515).

The control section 303 operates in accordance with the post processing conditions 320 and the delivery notice 321 from the controller 301. Thus, the operations of FIG. 7B are performed while the controller 301 performs the operations from S500 to S504 or the operations of S505 of FIG. 7A.

As described above, the uncurled sheet is conveyed in advance to the placement tray 205 before the stapling job is performed. Thus, even when the batch of downward curled sheets having undergone the stapling process is conveyed, the occurrences of a situation in which the upward curled sheet having already been place is pushed out can be suppressed.

As described above, according to the present embodiment, even when the stapling process is performed while the upward curled sheet is placed on the placement tray 205, the states similar to the FIGS. 5A to 5C can be obtained. Thus, pressing of the upward curled sheet having already been placed on the placement tray 205 can be suppressed.

Although the post processing performed by the post processing apparatus 200 is exemplified by the stapling process according to the above-described second embodiment, this is not limiting. The control of the present embodiment may be performed when the bookbinding process, the shifting process according to the first embodiment, or the stacking process is performed.

Furthermore, although only a single uncurled sheet is conveyed in advance to the placement tray 205 before the stapling job is performed according to the above-described second embodiment, this is not limiting. A plurality of uncurled sheets may be conveyed.

Furthermore, according to the above-described second embodiment, as described in the flowchart of FIG. 7A, control by which the uncurled sheet is discharged in advance to the placement tray 205 is performed for every batch of sheets to be curled downward. Alternatively, post processing control may be switched in accordance with information of a previous job. That is, the stapling job may be immediately performed when the control section 303 can determine that a sheet having already been placed on the placement tray 205 is curled downward in accordance with the previous job information or there is no sheet placed on the placement tray 205.

Furthermore, although the uncurled sheet is conveyed in advance to the placement tray 205 before the stapling job is performed according to the above-described second embodiment, this is not limiting. Alternatively, for example, a downward curled sheet having undergone duplex printing may be conveyed in advance to the placement tray 205. Furthermore, in order to indicate the sheet is an excess sheet, a message may be printed on the sheet to be conveyed.

Third Embodiment

Control according to a third embodiment is described by which, when conveying a plurality of sheets to the placement tray 205, a sheet on which an image is formed last is curled downward so as to be discharged. Since description of a main part of the third embodiment is similar to or the same as that of the first embodiment, only part of the third embodiment different from the first embodiment is described here.

Figure 8:
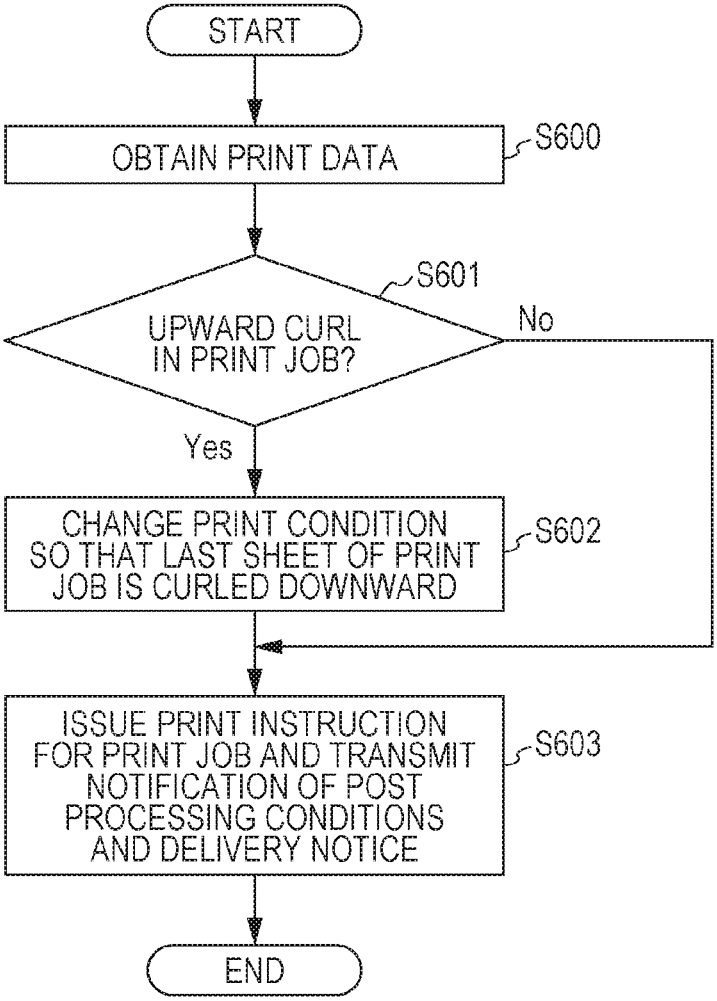
FIG. 8 is a flowchart of an image forming apparatus and a post processing control according to a third embodiment.

FIG. 8 is a flowchart illustrating operations of the image forming apparatus 100 according to the present embodiment. Types of control in accordance with the flowchart of FIG. 8 are performed by the controller 301 in accordance with software stored in the ROM (not illustrated) or the like.

Initially, upon obtaining print data from the external device 300 (S600), the controller 301 determines whether or not the sheets are to be curled upward in a print job (S601). When it is determined that the sheets are to be curled upward in the print job, the controller 301 changes a print condition (image forming condition) for the last sheet so that the last sheet of this print job is curled downward (S602).

With the configuration according to the present embodiment, a print condition under which downward curl occurs is performing of duplex printing and a print condition under which upward curl occurs is performing of simplex printing. That is, content of instruction is changed so as to perform duplex printing on the sheet which is instructed to undergo simplex printing. Here, when simplex printing is changed to duplex printing, the sheet is inverted when being discharged to the placement tray 205. In order to address this, the controller 301 also changes the order of image formation when changing simplex printing to duplex printing. It is noted that, when simplex printing is changed to duplex printing, an image is not necessarily printed on the other side of the sheet. The sheet can be curled downward by being passed through the fixing device 103 twice without printing an image.

When the print condition is changed in S602, the controller 301 issues a print instruction to the printer control section 302 and transmits notifications of the post processing conditions 320 and the delivery notice 321 to the post-processing-apparatus control section 303 so as to process the print job (S603). In the case where it is determined in S601 that the sheets are not to be curled upward, the controller 301 executes a printing operation of S603 without changing the print condition of the print job.

Figure 9A:
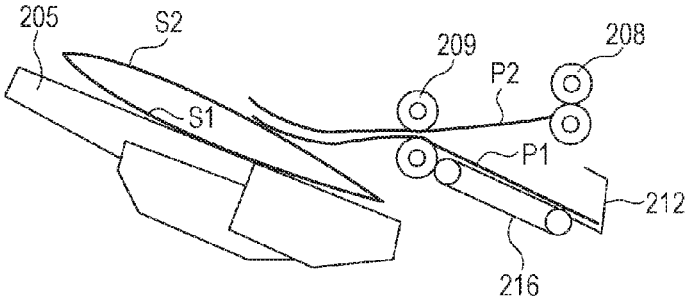
FIGS. 9A to 9C are sectional views illustrating placement states of sheets according to the third embodiment.
Figure 9B:
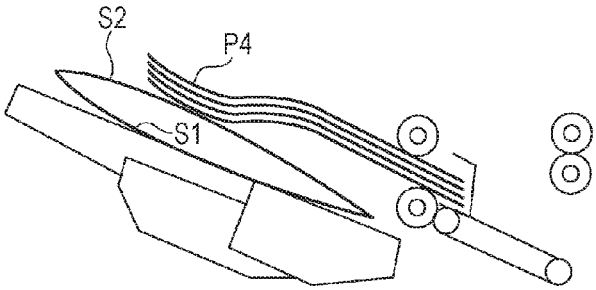
Figure 9C:
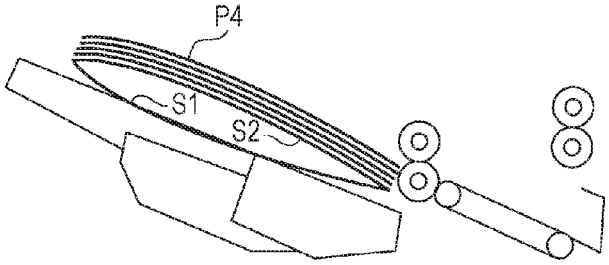

FIGS. 9A to 9C illustrate placement states while the operations according to the present embodiment are being performed. FIGS. 9A to 9C are, similar to FIGS. 5A to 5C, sectional views of the post processing apparatus 200.

FIG. 9A illustrates the state of the placement tray 205 after processing from S600 to S603 has been performed. Here, a sheet S1 and a sheet S2 are conveyed to the placement tray 205 as a result of performing of the same print job. The sheet S1 and the sheet S2 are to be curled upward, that is, instructed to undergo simplex printing. However, the sheet S2 being the last sheet is curled downward because duplex printing is performed on the sheet S2.

Referring to FIGS. 9B and 9C, a sheet P1 to P4 are newly conveyed to the placement tray 205. The sheets P1 to P4 are conveyed to the placement tray 205 as a result of performing of the same print job. As illustrated in FIG. 9C, the sheet S2 is curled downward. Thus, even when the downward curled sheets P1 to P4 are collectively conveyed from the processing tray 204 to the placement tray 205, the positions of the sheets S1 and S2 are not shifted.

As described above, according to the present embodiment, when performing a print job in which sheets are determined to be curler upward, one of the sheets to be placed at the uppermost position is curled downward. Thus, a post processing apparatus can be provided which has a placement suitability that is the same as or similar to those illustrated FIGS. 5A to 5C when receiving a new print job.

According to the first to third embodiments having been described, an example in which the post processing apparatus 200 is integrated with the image forming apparatus 100 are described. In contrast, the post processing apparatus 200 may be removably provided in the image forming apparatus 100. In this case, an independent control section is provided in the post processing apparatus 200 so as to communicate with a control section provided in the image forming apparatus 100, thereby controlling operations. Alternatively, the post processing apparatus 200 may be provided such that the post processing apparatus 200 is simply attachable to the image forming apparatus 100.

Furthermore, although an example of the laser beam printer is described in the first to third embodiments, the image forming apparatus to which the present disclosure is applied is not limited to this and may be any of printers or copiers using other printing methods such as an inkjet printer.

While aspects of the present disclosure have been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-208877, filed Oct. 23, 2015, and No. 2016-162209, filed Aug. 22, 2016, which are hereby incorporated by reference herein in their entirety.

What is claimed is:

1. A post processing apparatus attachable to an image forming apparatus, the post processing apparatus comprising:

a first placement unit on which a recording material conveyed from the image forming apparatus is placed;

a post processing unit that performs specified post processing on the recording material placed on the first placement unit;

a discharging unit that discharges the recording material placed on the first placement unit after the specified post processing has been performed by the post processing unit;

a second placement unit on which the recording material discharged by the discharging unit is placed; and a control unit that controls the post processing unit and the discharging unit, wherein, in a state in which the post processing apparatus is attached to the image forming apparatus and a predetermined recording material which is curled relative to a placement surface of the second placement unit is placed on the second placement unit, when a plurality of the recording materials which are curled in a direction different from a direction in which the predetermined recording material is curled are discharged to the second placement unit, the control unit performs post processing control in which the control unit causes the post processing unit to perform the specified post processing on at least one recording material of the plurality of recording materials, causes the discharging unit to discharge the at least one recording material to the second placement unit, and after the discharge, causes the post processing unit to perform the specified post processing on a recording material or recording materials of the plurality of recording materials other than the at least one recording material, and causes the discharging unit to discharge the recording material or the recording materials of the plurality of recording materials other than the at least one recording material to the second placement unit.

2. The post processing apparatus according to claim 1, wherein, when the control unit determines that the predetermined recording material is placed on the second placement unit and the control unit causes the plurality of recording materials to be discharged to the second placement unit, the control unit performs the post processing control, and wherein, when the control unit determines that the predetermined recording material is not placed on the second placement unit and the control unit causes the plurality of recording materials to be discharged to the second placement unit, the control unit does not performs the post processing control.

3. The post processing apparatus according to claim 1, wherein the specified post processing is a shifting process in which a jogger unit included in the post processing unit aligns the recording material or the recording materials placed on the first placement unit and shifts a position or positions of the aligned recording material or the aligned recording materials in a direction parallel to a placement surface of the first placement unit and perpendicular to a discharging direction of the recording material.

4. The post processing apparatus according to claim 1, wherein the at least one recording material is a first recording material of the plurality of recording materials.

5. An image forming apparatus comprising:

an image forming unit that forms an image on a recording material;

a first placement unit on which the recording material on which the image has been formed by the image forming unit is placed;

a post processing unit that performs specified post processing on the recording material placed on the first placement unit;

a discharging unit that discharges the recording material placed on the first placement unit after the specified post processing has been performed by the post processing unit;

a second placement unit on which the recording material discharged by the discharging unit is placed; and a control unit that controls the post processing unit and the discharging unit, wherein, in a state in which a predetermined recording material which is curled relative to a placement surface of the second placement unit is placed on the second placement unit, when a plurality of the recording materials which are curled in a direction different from a direction in which the predetermined recording material is curled are discharged to the second placement unit, the control unit performs post processing control in which the control unit causes the post processing unit to perform the specified post processing on at least one recording material of the plurality of recording materials, causes the discharging unit to discharge the at least one recording material to the second placement unit, and after the discharge, causes the post processing unit to perform the specified post processing on a recording material or recording materials of the plurality of recording materials other than the at least one recording material, and causes the discharging unit to discharge the recording material or the recording materials of the plurality of recording materials other than the at least one recording material to the second placement unit.

6. The image forming apparatus according to claim 5, wherein, when the control unit determines that the predetermined recording material is placed on the second placement unit and the control unit causes the plurality of recording materials to be discharged to the second placement unit, the control unit performs the post processing control, and wherein, when the control unit determines that the predetermined recording material is not placed on the second placement unit and the control unit causes the plurality of recording materials to be discharged to the second placement unit, the control unit does not performs the post processing control.

7. The image forming apparatus according to claim 5, wherein the specified post processing is a shifting process in which a jogger unit included in the post processing unit aligns the recording material or the recording materials placed on the first placement unit and shifts a position or positions of the aligned recording material or the aligned recording materials in a direction parallel to a placement surface of the first placement unit and perpendicular to a discharging direction of the recording material.

8. The image forming apparatus according to claim 5, wherein the at least one recording material is a first recording material of the plurality of recording materials.

9. An image forming apparatus comprising:

an image forming unit that forms an image on a recording material;

a first placement unit on which the recording material on which the image has been formed by the image forming unit is placed;

a post processing unit that performs specified post processing on the recording material placed on the first placement unit;

a discharging unit that discharges the recording material placed on the first placement unit after the specified post processing has been performed by the post processing unit;

a second placement unit on which the recording material discharged by the discharging unit is placed; and a control unit that controls the image forming unit, the post processing unit, and the discharging unit, wherein, in a state in which a predetermined recording material which is curled relative to a placement surface of the second placement unit is placed on the second placement unit, when a plurality of the recording materials which are curled in a direction different from a direction in which the predetermined recording material is curled are discharged to the second placement unit, the control unit performs post processing control in which the control unit causes at least one recording material on which an image is not formed by the image forming unit or at least one recording material which is different from the plurality of recording materials and which is curled in a direction different from a direction in which the predetermined recording material is curled to be discharged to the second placement unit, and after the discharge, causes the post processing unit to perform the specified post processing on the plurality of recording materials, and causes the discharging unit to discharge the plurality of recording materials to the second placement unit.

10. The image forming apparatus according to claim 9, wherein, when the control unit determines that the predetermined recording material is placed on the second placement unit and the control unit causes the plurality of recording materials to be discharged to the second placement unit, the control unit performs the post processing control, and wherein, when the control unit determines that the predetermined recording material is not placed on the second placement unit and the control unit causes the plurality of recording materials to be discharged to the second placement unit, the control unit does not performs the post processing control.

11. The image forming apparatus according to claim 9, wherein the specified post processing is a stapling process in which a jogger unit included in the post processing unit aligns the plurality of recording materials placed on the first placement unit and a stapler included in the post processing unit binds the aligned plurality of recording materials.

12. The image forming apparatus according to claim 9, wherein, in the post processing control, a single recording material of the at least one recording material on which an image is not formed or a single recording material of the at least one curved recording material different from the plurality of recording materials is caused to be discharged to the second placement unit by the control unit.

13. An image forming apparatus comprising:

an image forming unit that forms an image on a recording material;

a first placement unit on which the recording material on which the image has been formed by the image forming unit is placed;

a post processing unit that performs specified post processing on the recording material placed on the first placement unit;

a discharging unit that discharges the recording material placed on the first placement unit after the specified post processing has been performed by the post processing unit;

a second placement unit on which the recording material discharged by the discharging unit is placed; and a control unit that controls the image forming unit, the post processing unit, and the discharging unit, wherein, when receiving an instruction to form images on a plurality of the recording materials and discharge the plurality of recording materials to the second placement unit under an image forming condition under which the plurality of recording materials are curled relative to a placement surface of the second placement unit, the control unit changes the image forming condition so that one of the plurality of recording materials on which an image is formed last is curled in a direction different from a direction in which the other recording materials are curled.

14. The post processing apparatus according to claim 1, wherein the predetermined recording material is concavely curled relative to the placement surface of the second placement unit upward in a vertical direction, and the plurality of the recording materials are convexly curled relative to the placement surface of the second placement unit upward in the vertical direction.

15. The post processing apparatus according to claim 14, wherein a leading edge and a trailing edge of the predetermined recording material concavely curled are positioned above a center thereof in the vertical direction, and a leading edge and a trailing edge of the plurality of the recording materials convexly curled are positioned below a center thereof in the vertical direction.

16. The post processing apparatus according to claim 1, wherein, in the state in which the post processing apparatus is attached to the image forming apparatus and the predetermined recording material is placed on the second placement unit, a part of a recording material placed on the first placement unit contacts with the predetermined recording material.

17. The image forming apparatus according to claim 5, wherein the predetermined recording material is concavely curled relative to the placement surface of the second placement unit upward in a vertical direction, and the plurality of the recording materials are convexly curled relative to the placement surface of the second placement unit upward in the vertical direction.

18. The image forming apparatus according to claim 9, wherein the predetermined recording material is concavely curled relative to the placement surface of the second placement unit upward in a vertical direction, and the plurality of the recording materials are convexly curled relative to the placement surface of the second placement unit upward in the vertical direction.

19. The image forming apparatus according to claim 13, wherein the predetermined recording material is concavely curled relative to the placement surface of the second placement unit upward in a vertical direction, and the plurality of the recording materials are convexly curled relative to the placement surface of the second placement unit upward in the vertical direction.

20. An image forming apparatus comprising:

an image forming unit that forms an image on a recording material;

a first placement unit on which the recording material on which the image has been formed by the image forming unit is placed;

a post processing unit that performs specified post processing on the recording material placed on the first placement unit;

a discharging unit that discharges the recording material placed on the first placement unit after the specified post processing has been performed by the post processing unit;

a second placement unit on which the recording material discharged by the discharging unit is placed; and a control unit that controls the post processing unit and the discharging unit, wherein, in a case where, after the image forming unit forms an image on a predetermined recording material and the discharging unit discharges the predetermined recording material to the second placement unit, the image forming unit forms an image on a plurality of recording materials under a condition different from a condition for the predetermined recording material and the discharging unit discharges the plurality of recording materials to the second placement unit, the control unit performs post processing control in which the control unit causes the post processing unit to perform the specified post processing on at least one recording material of the plurality of recording materials, causes the discharging unit to discharge the at least one recording material to the second placement unit, and after the discharge, causes the post processing unit to perform the specified post processing on a recording material or recording materials of the plurality of recording materials other than the at least one recording material, and causes the discharging unit to discharge the recording material or the recording materials of the plurality of recording materials other than the at least one recording material to the second placement unit.

21. The image forming apparatus according to claim 20, wherein the image forming unit forms the image on one side only of the predetermined recording material, and the image forming unit forms the image on both sides of the plurality of recording materials.

22. The image forming apparatus according to claim 20, wherein, when the control unit determines that the predetermined recording material is placed on the second placement unit and the control unit causes the plurality of recording materials to be discharged to the second placement unit, the control unit performs the post processing control, and wherein, when the control unit determines that the predetermined recording material is not placed on the second placement unit and the control unit causes the plurality of recording materials to be discharged to the second placement unit, the control unit does not performs the post processing control.

23. The image forming apparatus according to claim 20, wherein the specified post processing is a shifting process in which a jogger unit included in the post processing unit aligns the recording material or the recording materials placed on the first placement unit and shifts a position or positions of the aligned recording material or the aligned recording materials in a direction parallel to a placement surface of the first placement unit and perpendicular to a discharging direction of the recording material.

24. The image forming apparatus according to claim 20, wherein the at least one recording material is a first recording material of the plurality of recording materials.

25. The image forming apparatus according to claim 20, wherein, in the state in which the predetermined recording material is placed on the second placement unit, a part of a recording material placed on the first placement unit contacts with the predetermined recording material.

* * * * *